United States Patent [19]

Schmeling

[11] 4,372,363

[45] Feb. 8, 1983

[54] BAG CLOSURE

[76] Inventor: Robert H. Schmeling, 5431 Via Aquario, San Diego, Calif. 92111

[21] Appl. No.: 260,244

[22] Filed: May 4, 1981

[51] Int. Cl.[3] ..... B65D 33/06; B65D 33/30

[52] U.S. Cl. ..... 150/4; 150/12; 220/95

[58] Field of Search ..... 150/3, 4, 5, 12, 33, 150/42; 220/95

[56] References Cited

U.S. PATENT DOCUMENTS

| | | | |
|---|---|---|---|
| 503,113 | 8/1893 | Osterloh | 150/4 |
| 939,736 | 11/1909 | McKain | 150/4 |
| 1,728,521 | 9/1929 | Anderson | 220/95 X |

FOREIGN PATENT DOCUMENTS

| | | | |
|---|---|---|---|
| 62452 | 4/1929 | Fed. Rep. of Germany | 150/4 |

*Primary Examiner*—William Price
*Assistant Examiner*—Sue A. Weaver
*Attorney, Agent, or Firm*—Charmasson, Branscomb & Holz

[57] ABSTRACT

A closure is provided for a flexible bag such as a game bag used by skin divers which is very simply made of resilient metal bar stock which define two bails having handles acting as detents, the bails and handles being so configured and connected that the bails will open to a full-open position but no farther, and when closed a diver can close the bails and engage the handles in latched position with a single hand due to a double dimensional biasing created by the shaping and engagement of the bails and the bowed spanner bars of the handles.

2 Claims, 16 Drawing Figures

FIG. 7
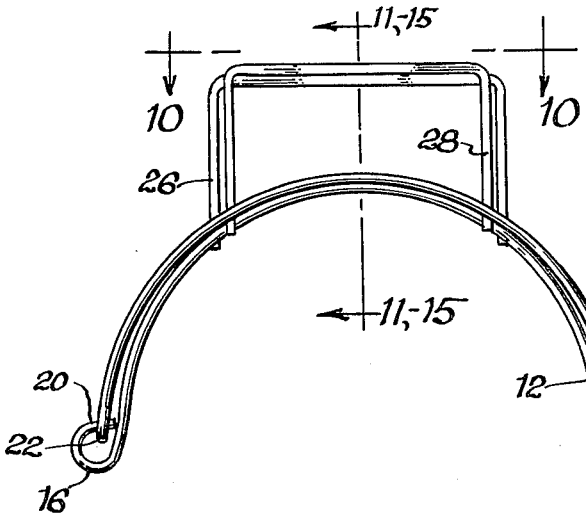
FIG. 8
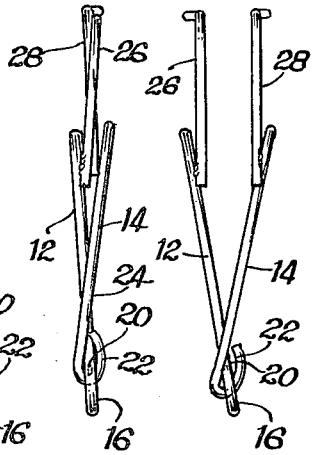
FIG. 9
FIG. 10
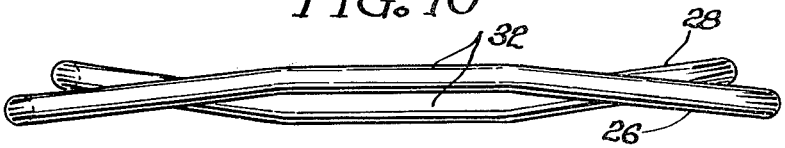
FIG. 11
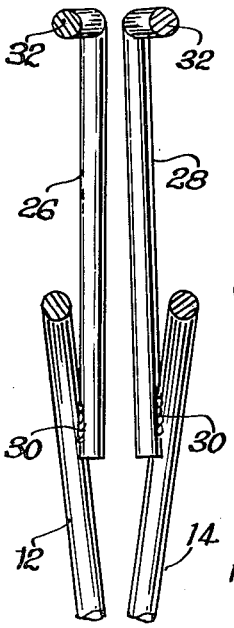
FIG. 12
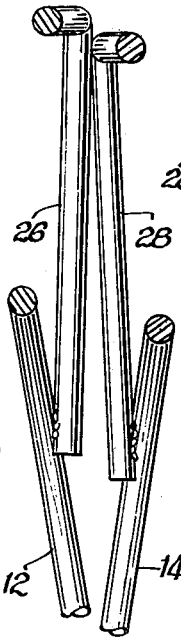
FIG. 13
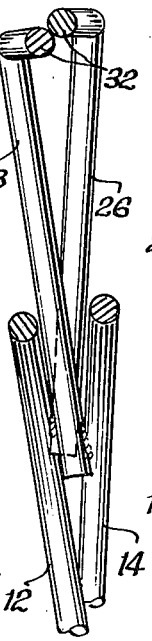
FIG. 14
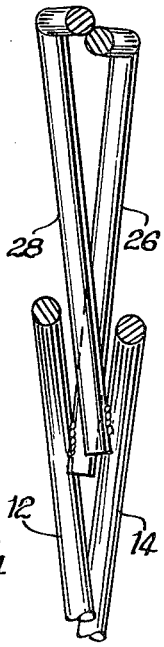
FIG. 15
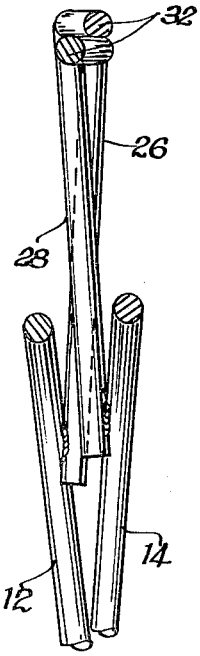

BAG CLOSURE

BACKGROUND OF THE INVENTION

There is a need among skin divers for a game bag that has some type of rigid opening and closure mechanism but that is simple enough that it will not rust or clog, and can be operated by one hand.

Current dive bags come in a variety of configurations ranging from a simple bag with no mouth closure at all to bags with clips or other devices which hold the handles together. Bags with no closure at all, and no means of holding the mouth of the bag open to insert game, are virtually impossible to use with anything other than inert forms of game such a shellfish. A speared fish pinned to the bottom or otherwise engaged at best only temporarily by one hand is virtually impossible to successfully transfer into a limp bag with no rigid mouth opening. Invariably while trying to cause the mouth of the bag to open with one hand, by drawing it back and forth in the water in all manner of gyrations, the fish escapes from the spear and swims off somewhere to die out of reach.

Other closures having latches effectively avoid the above stated problem, but vary in their degree of simplicity and the ability of the user to open and close the bag with only one hand, which is a virtual necessity when hunting with a spear or spear gun.

SUMMARY OF THE INVENTION

The present invention provides a bag closure of construction that is simultaneously elementally simple yet effective and adapted for one-handed use. The closure consists entirely of two bails comprised of resilient rod stock to which are spot welded a pair of handles of slightly different sizes which act as retainer and detent when the handles are snapped together.

This construction requires rather accurate fabrication inasmuch as the entire locking action depends on the shape of the bails and the handles all of the way from the bail hinges to the handle spanner bars, but once made, the closure can be effectively locked or opened single-handedly and has no moving parts other than the interconnected bails themselves.

BRIEF DESCRIPTION OF THE DRAWINGS

FIG. 7 is a front elevation view of the closure device;

FIGS. 8 and 9 are both side elevation views of the closure device in closed and open position, respectively;

FIG. 10 is an elevation view taken along line 10—10 of FIG. 7;

FIGS. 11 through 15 illustrate the closing sequence of the preferred embodiment.

DETAILED DESCRIPTION OF THE PREFERRED EMBODIMENT

Figure 1:
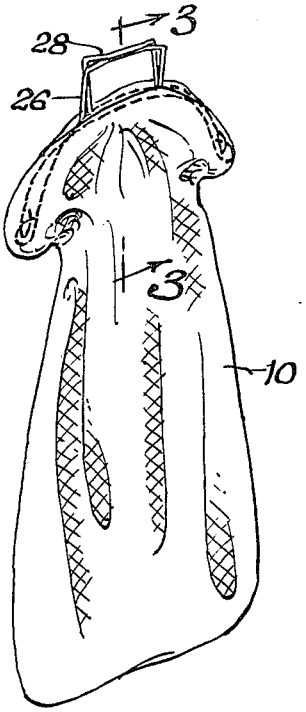
FIG. 1 is a perspective of a game bag in which the instant closure is incorporated.
Figure 2:
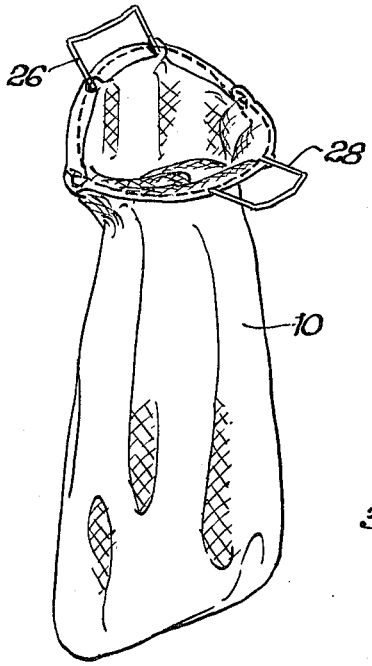
FIG. 2 illustrates the bag in open position.
Figure 3:
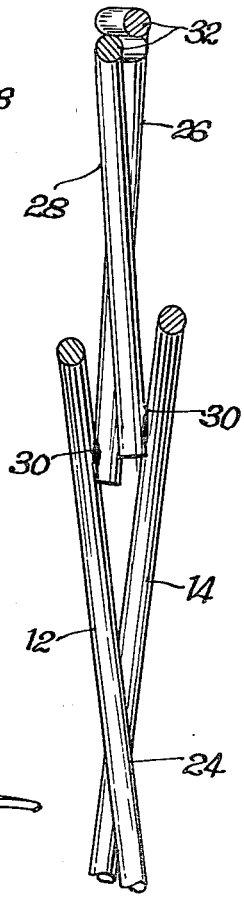
FIG. 3 is a section taken along line 3—3 of FIG. 1.

The invention is used in conjunction with a game bag under ordinary circumstances as shown in FIGS. 1 and 2 at 10. Although intended for use with a game bag, the application of the closure would extend to any flexible mouthed bag connectable to hinged bails.

Figure 5:
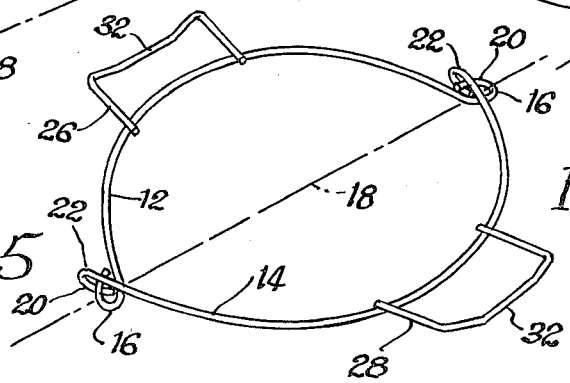
FIG. 5 is an opened closure of the type shown in FIG. 4 illustrating the limiting action of the hinges.
Figure 6:
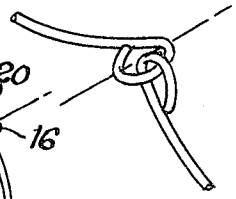
FIG. 6 is a detail illustrating a hinge arrangement without limiting action.

The closure itself comprises a pair of slightly different bails 12 and 14. Bail 12 extends down slightly lower than bail 14 and defines loops 16 which lie substantially in the plane of axis 18 and the bail itself. These loops loop upwardly, and engaged on their top leg 20 in both instances is a loop 22 defined at the lower ends of second bail 14. Although a connection shown in FIG. 6 could be arranged in the alternative, the advantage of the looping of loop 22 around the top leg 20 of the other loop is shown in FIG. 5 wherein the two bails will open almost to 180° and will open no further. The advantage of this lies in the easy ability of the diver to hold the mouth open while inserting game, which is often struggling so that the last thing the diver needs is a game bag with a mouth that folds back on itself while the fish is flopping around halfway off of a spear.

Returning to bail 12, it can be seen that it extends down below the bottom of bail 14 but is somewhat narrower at the hinged ends, and at its top it is slightly lower than bail 14 so that the two bails cross somewhere between the handles and the hinges at points indicated at 24.

Figure 4:
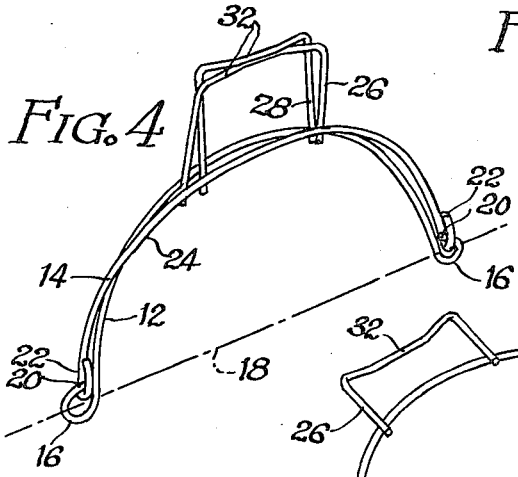
FIG. 4 is a perspective of the closure in closed position with the bag removed.
Figure 4A:
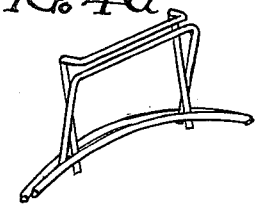
FIG. 4*a* is a detail of the closure showing a slight modification utilizing straight spanner bars.

At the top of bail 12 is a handle 26 which is wider than, although not quite as high as, the handle 28 for the other bail 14. These handles are each made of the same slightly resilient metal stock as are the bails and are tack welded at 30 to the top portion of the bails. Additionally, in its preferred embodiment, each bail handle has a bowed spanner portion 32 which is generally contained within a surface tangential to arcs described around the axis 18. These bowed spanners engage as is best shown in FIG. 4 to very effectively lock the bag closure shut once it is snapped into position.

A process whereby the two handles are locked in position is made possible by the double resiliency built into the shapes of the two bails and their respective handles. The wider, lower handle 26 acts as a retainer under which the taller narrower handle 28 snaps through acting as a detent. The first biasing action, which biases the handle 28 upward relative to the wider handle 26 which can best be visualized from FIG. 7, is achieved by the positioning of the loops 16 and 22 which define the hinges for the bails. The upper loop 22 rides low on the lower loop, and resists pressing the handle 28 down to the degree necessary to pass the spanner bar 32 through the handle 26 so that there can be a snapping action. If the clearance is machined closely enough, the resiliency of the lower handle and attached bail will bring it up into contact with the upper spanner bar, providing a positive closure. Once the handle 28 has passed through handle 26, this built-in biasing mechanism acts as a positive stop to prevent the handles from disengaging. However, the engagement is not so positive that a sharp separating thrust might not separate the two handles, and to completely avoid this possibility, the bowed spanner portions of the handles overlap as shown in FIG. 4 after they are engaged and are held firmly in this position by the bias created by the cross-points of the bails. It can thus be seen from an examination of FIG. 4, and also FIG. 15, that a force tending to separate the handles 26 and 28 after they have been completely engaged would be unsuccessful because of the positive overlapping detaining action of the spanner bars 32.

This mechanism insures that the bag will stay closed during active manipulation as in an underwater environment. When closed, pressure exerted on the closure by pulling on the bails or on the bag fabric only results in locking the handles tighter, and preventing inadvertent opening of the bag.

Pertinent to this point it should be noted that the sequence of closure indicated in FIGS. 11 through 15, although accurate, are taken through a section in the spanner bars indicated in FIG. 7 such that it appears these spanner bars are not continuously in contact during the closure process. However, this is not the case as the double biasing mentioned effected by the loop hinges and the bail cross-points 24 causes a constant biasing contact of the inner handle against the outer handle as the former is rotated into locked position around the outer. The essential functioning of the locking mechanism is illustrated in FIGS. 11 through 15 in that handle 28 passes down through behind up and over handle 26.

The function thus described can be accomplished with any number of different configurations of the bail and handle assemblies as long as these operational steps are accomplished. For instance, FIG. 4(*a*) illustrates an alternative configuration of the handles wherein the larger of the handles is a simple rectangular shape and the smaller which passes through the larger is formed with a straight engaging top bar set at an angle projecting from the plane of the supporting sides of the handle. Thus, the smaller handle will positively hook over the larger handle in the same manner as the embodiment previously described.

The basic closure mechanism could also be constructed with no bowing, bending or protrusion of the handle spanner bar, that is, the handles would consist of a simple planar rectangle such that one spanner would pass under and behind the other, being spring-biased to then move up to a retaining position behind the other but not over the other as in previously described embodiments. This embodiment would still maintain the one-handed continuous contact closure sequence described, though without the security of the final overcenter step.

As thus described and illustrated, a closure is provided particularly adapted to the needs of skin divers but adaptable for application and other arts, which is elegantly simple in construction, concept and execution, which has only two moving parts with no moving latch structure, and which is virtually immune to clogging, jamming, or other interference to its operation being caused by adverse marine conditions, and at the same time being ideal for one-handed operation, both for opening and closing, and extremely reliable due to the simplicity of its construction. While I have described the preferred embodiment of the invention, other embodiments may be devised and different uses may be achieved without departing from the spirit and scope of the appended claims.

What is claimed is:

1. A bag enclosure comprising:

(a) a pair of bails hinged together at their ends to define a hinge axis and having a front side which defines the open mouth of a bag engaged thereon and a back side comprising the other side;

(b) one of the bails having a retainer extending therefrom which includes a component generally parallel to said axis, and the other of said bails having a detent which passes around the radial inside of said generally parallel component to be positively engaged on the back side thereof as said bails are closed, said bails being dimensioned and hinged to bias said detent outwardly as same rotates beneath and behind said retainer, whereby a bag having a flexible mouth engaged around said bail can be alternatively positively shut or open;

(c) said bails being resiliently hinged together in order to maintain contact between said detent and said retainer as the detent is moved relative to the retainer to lock or unlock the enclosure;

(d) said retainer and detent comprising loop handles extending from respective ones of said bails with the former being wider than the latter to permit the detent handle to pass through the retainer handle; and (e) each of said handles defining a spanner bar which engages the other of said spanner bars when said closure is closed, and at least one of said spanner bars being bowed in the direction tangential to a rotational arc established around said axis and toward the other spanner bar, whereby said detent spanner bar passes through, up past, and over said retainer spanner bar against both radial and angular biasing to positively lock said handles together.

2. Structure according to claim 1 wherein said handles, bails and hinges are all fabricated of resilient metal rodstock.

* * * * *